US005532210A

United States Patent [19]

Shen

[11] Patent Number: 5,532,210

[45] Date of Patent: Jul. 2, 1996

[54] HIGH TEMPERATURE SUPERCONDUCTOR DIELECTRIC SLOW WAVE STRUCTURES FOR ACCELERATORS AND TRAVELING WAVE TUBES

[75] Inventor: Zhi-Yuan Shen, Wilmington, Del.

[73] Assignee: E. I. Du Pont de Nemours and Company, Wilmington, Del.

[21] Appl. No.: 255,516

[22] Filed: Jun. 8, 1994

[51] Int. Cl.[6] ..... H01J 23/24; H01J 25/34; H05H 9/02; H01B 12/06

[52] U.S. Cl. ..... 505/200; 505/210; 505/700; 505/701; 505/866; 315/3.5; 315/5.41; 333/99 S

[58] Field of Search ..... 315/3.5, 3.6, 39.3, 315/5.41; 333/99 S; 505/200, 210, 700, 701, 866

[56] References Cited

U.S. PATENT DOCUMENTS 3,475,642 10/1969 Karp et al. ..... 315/3.5
4,820,688 4/1989 Jasper, Jr. ..... 305/200
5,324,713 6/1994 Shen ..... 505/210

FOREIGN PATENT DOCUMENTS 3159029 7/1991 Japan ..... 315/39.69

OTHER PUBLICATIONS

Llopis, O., et al; "Microwave Characterization of High Tc Superconductors with a Dielectric Resonator"; *Journal of Less–Common Metals*; vol 164 and 165 (1990); pp. 1248–1251.

Braginsky et al., Experimental Observation of Fundamental Microwave Absorption in High–Quality Dielectric Crystals, *Physics Letters A*, 120, #6, 300–305, 1987.

*Primary Examiner*—Benny T. Lee

[57] ABSTRACT

Periodic and pseudo-periodic slow wave structures comprising a plurality of adjacent sections, each section comprising a dielectric ring in contact with a disk coated with high temperature superconducting thin film, having coupling between the sections and tunable phase velocity for use in particle accelerators and traveling wave tubes are disclosed.

17 Claims, 8 Drawing Sheets

HIGH TEMPERATURE SUPERCONDUCTOR DIELECTRIC SLOW WAVE STRUCTURES FOR ACCELERATORS AND TRAVELING WAVE TUBES

FIELD OF THE INVENTION

This invention relates to slow wave structures made of high-temperature superconductors (HTS) and dielectric materials with high Q-value, high coupling impedance and high efficiency used for particle accelerators and traveling wave tubes.

BACKGROUND OF THE INVENTION

Particle accelerators for producing high energy charged particle beams are used for basic physics research and medical applications. The key component of an accelerator is a slow wave structure, which provides an interactive space for radio frequency (rf) fields to interact with the charged particles for acceleration. In order to accumulate the acceleration effect, the phase velocity of the rf fields must synchronize with the particle beam velocity. Therefore, the first specification of a slow wave structure is its phase velocity, $v_p$ as a function of frequency (or equivalently the slow wave ratio SWR=c/$v_p$, where c is the speed of light in the free space). In order to enhance the interaction of the rf fields and particles, the rf electrical field must be sufficiently high along the particles' beam path to produce a strong force for efficient acceleration. Therefore, the second specification of a slow wave structure is a parameter called the coupling impedance, $Z_c$, defined as:

$$Z_c = \frac{V^2}{2P} \tag{1}$$

where P is the dissipated power in one section of the slow wave structure.

$$V = \int_0^L E \cdot dl \tag{2}$$

is the E-field line integration along the particle path where E is the electrical field strength and dl is the differential line element at path of the charged particle beam and along the longitudinal slow wave structure; and L is the length of the section of the slow wave structure. Coupling impedance $Z_c$ can be expressed as $$Z_c = Q_0 G \tag{3}$$

where $Q_0$ is the unloaded Q-value of the structure and G is defined as the geometry factor:

$$G = \frac{V^2}{4Pf_0W_0} \tag{4}$$

where $f_0$ is the resonant frequency of the resonator and where $W_0$ is the stored energy in the resonator at the resonant frequency.

A dc high voltage, $V_o$, can be used to accelerate the charged particle beam to an initial "injection" velocity, v, fed into the slow wave structure. The non-relativity relation between $V_o$ and v is:

$$v = \sqrt{\frac{2eV_o}{m}} \tag{5}$$

where v, e and m are the velocity, electrical charge and the mass of the particles, respectively. Unless very high dc voltage is used, v is much less than the speed of light c, which means that the slow wave ratio should be much greater than unity at the entry sections of the slow wave structure and should gradually decrease to keep synchronized with the accelerated particle beam.

Slow wave structures are also used in traveling wave tubes (TWTs). Contrary to the accelerator case, the electron beam in a TWT is decelerated to tranfer energy to the rf fields for amplification. Such interaction also requires synchronization between the electron beam velocity, v, and the phase velocity, $v_p$, of the rf fields. The difference is that, in the accelerator case, v is less than or about equal to $v_p$, whereas in the TWT case, v is greater than or about equal to $v_p$.

The conventional slow wave structures have a tubular shape and are made of a common metal, such as copper, with a periodic structure along the longitudinal direction. These structures also can be viewed as a series of coupled resonant cavities. The phase velocity and the coupling impedance can be adjusted by varying the dimensions of the resonant cavities, or varying the coupling between the cavities. The main problem with these conventional metallic slow wave structures is the low coupling impedance, $Z_c$, due to the low Q-value. The low $Z_c$ causes a low efficiency, which must be compensated for by increasing input rf power and using a longer slow wave structure. Both measures are costly. One way to solve the problem is the use of a low temperature superconductor (LTS) such as niobium (Nb) or lead (Pb) to replace the normal metal used in making the slow wave structure. Such LTS slow wave structures have extremely high Q-values, e.g., up to $\mathbf{10^9}$, which greatly increases the $Z_c$ and thereby improves the efficiency. However, the LTS structures must be operated at or near liquid helium temperature (4.2 °K), which drastically complicates the overall structure and increases the cost. Except for some very special cases, the cost of operation of most acelerators at such a temperature cannot be justified.

The present invention overcomes the above-discussed problems by providing an HTS/dielectric slow wave structure operated at or near liquid nitrogen temperature (77 °K) with an extremely high Q-value. It provides an adjustable slow wave ratio suitable for accelerators and TWTs which improves their efficiency and shortens the length of the slow wave structure resulting in more compact accelerators.

Commonly assigned, copending application Ser. No. 07/788,063, filed Nov. 5, 1991, (now U.S. Pat. No. 5,324,713 issued Jun. 28, 1994) describes an HTS/dielectric $TE_{0in}$ (i and n=1,2, . . .) mode resonator. Several $TE_{011}$ mode HTS/sapphire resonators described therein demonstrated extremely high Q-values up to $3\times10^6$ and power handling capability up to $3\times10^4$ watts at 80K. This experimental data proved that thin film HTS materials, such as YBaCuO, TlBaCaCuO, and dielectric materials, such as single crystal sapphire ($\alpha$-$Al_2O_3$), are capable of achieveing extremely high Q-values at microwave frequencies for high power applications. However, such TE mode resonators do not have an E-field along the longitudinal direction, which is required by slow wave structures to interact with a charged particle beam. The present invention overcomes this problem by providing an HTS/dielectric structure formed by a series of TM or EM mode HTS/dielectric resonators, as described below in reference to FIGS. **1*a*–1*b***, which have all the characteristics required by a slow wave structure. The structures in accordance with this invention can greatly increase the accelerator's efficiency and make it more compact.

SUMMARY OF THE INVENTION

The present invention generally provides an HTS/dielectric periodic or pseudo-periodic slow wave structure used for accelerators or for TWTs. Because of the extremely low surface resistance, $R_s$, of the HTS thin films and the extremely high intrinsic Q-value of the dielectic materials employed, such as sapphire, ($\alpha$-$Al_2O_3$), at cryogenic temperatures, the HTS/dielectric slow wave structures of the present invention have an extremely high Q-value and very high coupling impedance. In other words, the overall efficiency of the accelerators or TWTs ulitizing such a slow wave structure is greatly improved. In addition, the total length of the slow wave structure is much shorter than the conventional one, which contributes to further reduction of the initial and operating costs for the accelerators and TWTs.

The present invention provides a periodic slow wave structure comprising:

(a) a plurality of adjacent sections, each section comprising a dielectric ring having a center hole in contact with a disk of larger diameter than the ring having a center hole and coated with a high temperature superconducting thin film on one or both sides, the adjacent sections positioned to align the center holes;

(b) means for coupling between adjacent sections;

(c) means for tuning phase velocity; and (d) an outer enclosure having particle beam entry and exit ports aligned with the center holes, and distinct radiofrequency entry and exit ports.

The dispersion curve and thereby the phase velocity of the slow wave structure can be adjusted. Also the coupling impedance can be adjusted. But in order to optimize both requires some trade-off and innovative design.

The present invention further comprises a pseudo-periodic slow wave structure comprising (a) a plurality of adjacent sections, each section comprising a dielectric ring having a center hole in contact with a disk of larger diameter having a center hole and coated with a high temperature superconducting thin film on one or both sides, the adjacent sections positioned to align the center holes, and the rings of adjacent sections being of continuously increasing lengths with a diameter adjusted in size to keep resonant frequency of the operating mode relatively constant, e.g., within ±1%;

(b) means for coupling between adjacent sections;

(c) means for tuning phase velocity; and (d) an outer enclosure having particle beam entry and exit ports aligned with the center holes, and distinct radiofrequency entry and exit ports.

Such a pseudo-periodic structure provides a varying phase velocity along the charged particle beam path to enhance the interaction between the beam and the rf field along the entire path of the charged particles throughout the structure and thereby increases efficiency.

The present invention further comprises a charged particle accelerator or a traveling wave tube incorporating the periodic slow wave structure or pseudo-periodic slow wave structure described above.

BRIEF DESCRIPTION OF THE DRAWINGS

FIG. 1*a* shows the end view of the periodic structure and FIG. 1*b* shows the longitudinal cross-sectional view thereof. The length of a single section of the structure is indicated by L.

FIG. 2*a* shows an end view of the dielectric ring and FIG. 2*b* shows the longitudinal cross-sectional view thereof.

FIG. 3*a* shows a top or front view of superconductor film deposited on a substrate wafer or disk 2 or 3; FIG. 3*b* shows a cross-sectional view of disk 2 and FIG. 3*c* shows a cross-sectional view of disk 3.

FIG. 4*a* shows the end view thereof and FIG. 4*b* shows the cross-sectional view thereof.

FIG. 5*a* is a graph of k vs. $\beta$ and shows the generalized dispersion curve (k-$\beta$ curve) of the $TM_{01}$ mode. FIG. 5*b* shows the phase velocity of the $TM_{01}$ mode as a function of frequency.

FIG. 7*a* shows the end view thereof and FIG. 7*b* shows the longitudinal cross-sectional view thereof.

FIG. 8*a* shows a top or from view of the disk and FIG. 8*b* shows a cross-sectional view thereof.

FIG. 9*a* shows a top or front view thereof and FIG. 9*b* shows a cross-sectional view thereof.

FIG. 10*a* shows a cross-sectional view thereof and FIG. 10*b* shows an enlarged view of the connection between the slow wave structure and the enclosure case.

DETAILED DESCRIPTION OF THE INVENTION

The present invention provides slow wave structures of increased efficiency and reduced length for use in charged particle accelerators and traveling wave tubes, which improves their performance and at the same time reduces their cost. Such accelerators are useful in research applications and in the medical area to treat diseased tissue with various types of radiation.

The basic function of slow wave structures is to provide an interactive space for the rf field and the charged particle beam to exchange energy. The efficiency of the energy exchange is mainly determined by two factors: (1) synchronization of the velocities of the rf fields and the beam, (2) electrical field (E-field) strength along the beam path. The synchronization requires that the phase velocity of the slow wave is approximately equal to the velocity of the particle beam. For the non-relativity particle beam in the initial section of high energy particle accelerators or in low energy accelerators for medical applications, a large slow wave ratio, SWR, is required. The present invention provides an HTS/dielectric periodic or pseudo-periodic structure to achieve a large and adjustable SWR. According to equation (3), the coupling impedance, $Z_c$, which describes the E-field strength relative to power, can be expressed as as the product of the Q-value, $Q_0$, and the geometry factor, G. The present invention provides an extremely high $Q_0$ and a reasonably high G, thereby, very high $Z_c$ can be achieved to increase the efficiency.

Figure 4B:
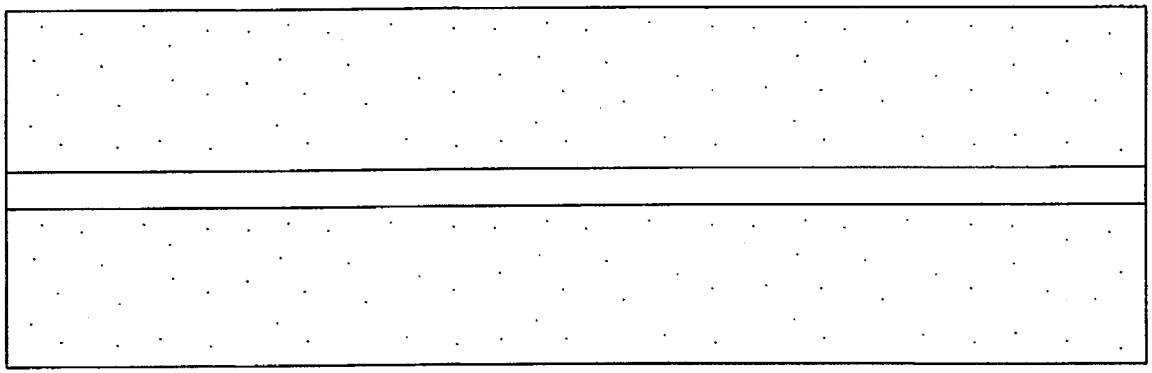
FIGS. 4*a*–4*b* are schematic drawings of a tubular dielectric slow wave structure.

An electromagnetic wave traveling in an uniform dielectric medium has a phase velocity of $v_p=c/(\epsilon_r)^{1/2}$ which is less than the speed of light, c, (for $\epsilon_r>1$). Therefore, a dielectric tube, as described below in reference to FIGS. 4a–4b, can be used as a slow wave structure. FIG. 5a shows the k-β relation, known as the dispersion curve, of the slow wave structure shown in FIGS. 4a–4b. FIG. 5b shows the phase velocity of the $TM_{01}$ mode as a function of frequency. The $v_p$ has a lower limit of $c/(\epsilon_r)^{1/2}$. Sapphire is the preferred dielectric material in the practice of this invention due to its appropriate dielectric constant, ($\epsilon_r$=11.6 for the TM mode propagating along the c-axis, that is, along the orientation of the unit cell of the crystal structure having the longest unit length dimension) and its extremely high Q-value on the order of $10^7$ at liquid nitrogen temperatures. From the standpoint of properties, cost and availability sapphire is currently the ideal material for such a slow wave structure. But the main problem is that the slow wave ratio less than $(\epsilon_r)^{1/2}$ is about 3.4, and is not sufficient for most accelerators especially at the initial stage. Of course, dielectric materials having an $\epsilon_r$ much higher than sapphire do presently exist, but their Q-values are too low even at cryogenic temperatures for such application.

Figure 7B:
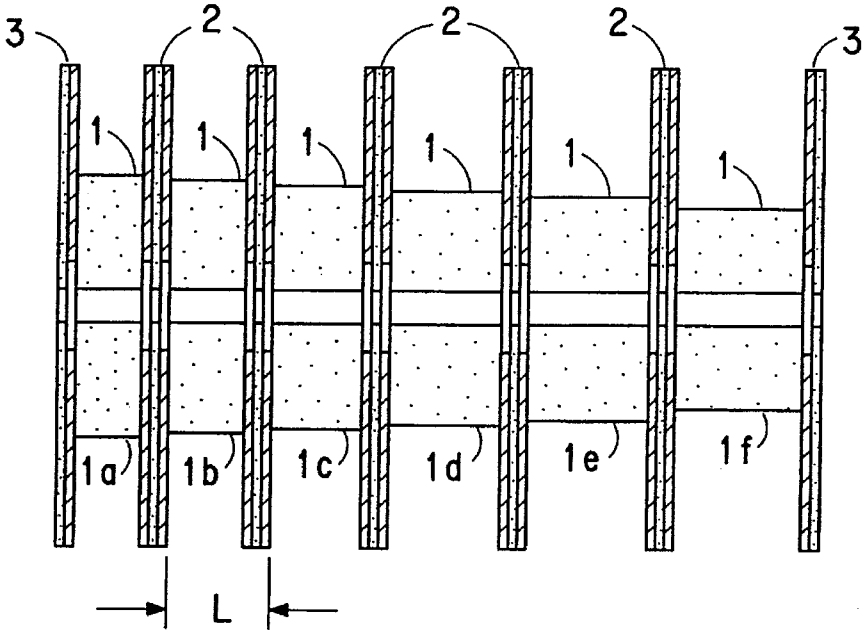
FIGS. 7*a*–7*b* are schematic drawings of an embodiment of an HTS/dielectric pseudo-periodic slow wave structure of this invention.
Figure 7A:
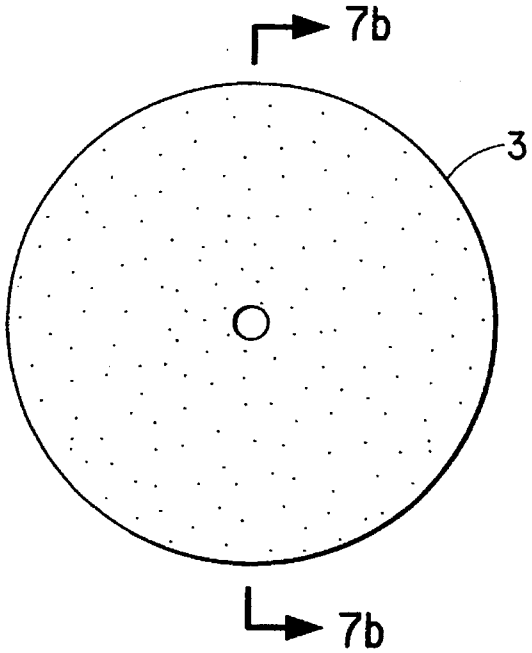

The present invention solves the problem of the slow wave ratio by introducing the HTS disks into the structure as a load to form a periodic structure (FIGS. 1a–1b, described below) or pseudo-periodic structure (FIGS. 7a–7b, described below). The introduction of HTS disks not only increases the slow wave ratio, but also makes it adjustable by varying the dimensions of the structure to meet the slow wave ratio requirement. The slow wave structures of the present invention have extremely high Q-values close to the intrinsic Q-value of sapphire and multi-kilowatts power handling capability operating at or near liquid nitrogen temperature. Such a slow wave structure greatly improves an accelerator's efficiency and shortens its overall length to save energy and cut the cost of the accelerator. Traveling wave tubes also benefit from using such slow wave structures.

Suitable operating modes for the periodic and pseudo-periodic structures of the present invention are the TM or EM modes, which have a longitudinal E-field in the interactive space where the rf field and the charged particle beam exchange energy. In the structures of the present invention the TM or EM operating modes have a longitudinal E-field in the region of the aligned center holes of the dielectric rings and HTS-coated disks. The preferred operating modes for use in the structures of the present invention are $TM_{01}$ and $EM_{01}$.

Periodic Structure

Figure 1B:
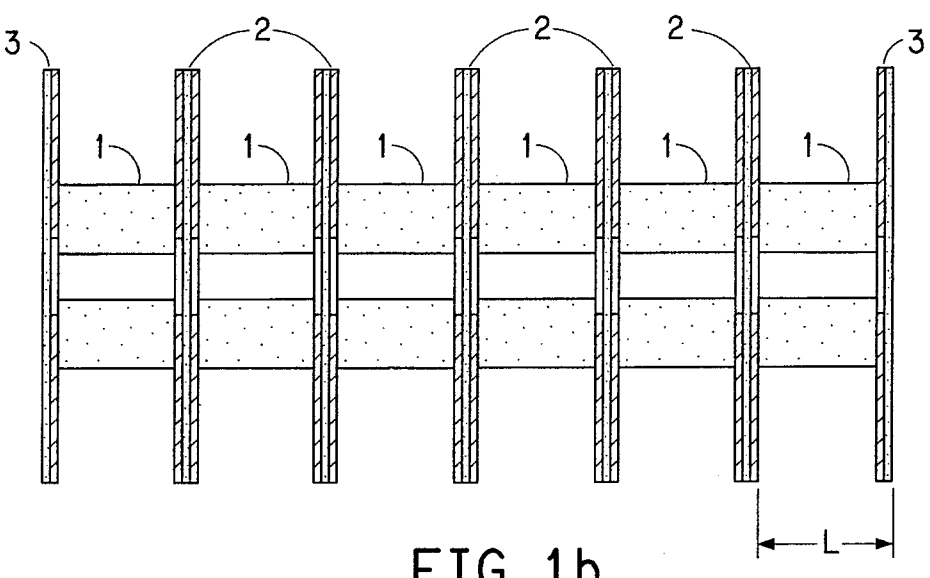
FIGS. 1*a*–1*b* are schematic drawings for an embodiment of an HTS/dielectric slow wave structure of the present invention.
Figure 1A:
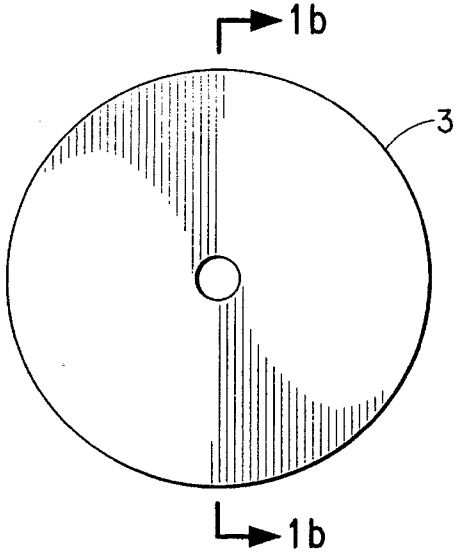

FIGS. 1a–1b show an embodiment of the HTS/dielectric periodic slow wave structure of the present invention. FIG. 1a shows the end view and FIG. 1b shows the longutudinal cross-sectional view. In this embodiment, the slow wave structure comprises six dielectric rings 1 and seven HTS-coated disks 2 and 3. The dielectric rings and the HTS disks are placed alterately as shown in FIG. 1b to form a 6-section periodic structure. A section or period consists of one dielectric ring in contact with one HTS-coated disk, the length of the period or section being represented by L in FIG. 1b. The center holes of the HTS-coated disks and the dielectric rings are aligned to form a path for the charged particles beam, which also serves as the interactive area for the beam to interact with the rf fields. In the accelerator case, the number of sections contained in the invented HTS-dielectric periodic or pseudo-periodic structures depend upon the required beam energy and the power of the rf source feeding the accelerator. A minimum of three dielectric rings and four HTS-coated disks are required to form a structure of the present invention, but preferably 12 or more sections are present.

Figure 2B:
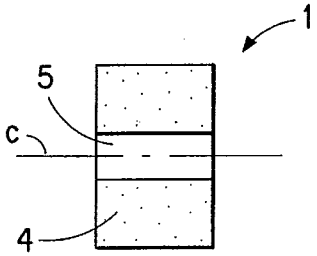
FIGS. 2*a*–2*b* are schematic drawings of the detailed structure of the dielectric ring 1, in the slow wave structure shown in FIGS. 1*a*–1*b*.
Figure 2A:
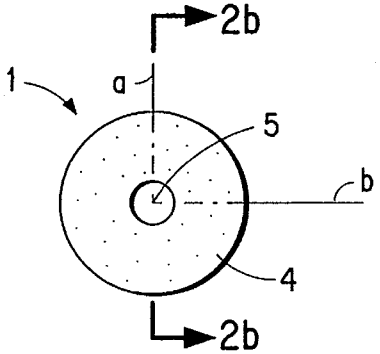

FIGS. 2a–2b show the structure of the dielectric ring indicated generally at 1 in FIGS. 2a and 2b. FIG. 2a shows its end view and FIG. 2b shows its longitudinal cross-sectional view. The dielectric ring body 4 contains hole 5 providing the path for the charged particle beam. The dielectric ring is made of dielectric materials having a high $\epsilon_r$ and extremely low loss tangent, tanδ. The high $\epsilon_r$ is needed for a large slow wave ratio, and the extremely low tanδ is needed for the required extremely high Q-value. The most preferred dielectic material is the single crystal sapphire ($\alpha$-$Al_2O_3$). Sapphire is an anisotropic dielectric material with $\epsilon_a$, $\epsilon_b$=9.3 along the a and b axes, respectively and $\epsilon_c$=11.6 along the c-axis. The c-axis must be aligned along the longitudinal direction of the ring in order to maintain azimuthal symmetry required by the slow wave structure. Pure saphhire has extremely low tanδ at cryogenic temperatures, an imperical equation is given by (6) as:

$$\tan\delta = a\,T^{4.75} \tag{6}$$

where T is the temperature in K, and $a=3.5\times10^{-17}/K^{4.75}$. At 77K, tanδ is in the $10^{-7}$ to $10^{-8}$ range, which is suitable for such applications. To reduce the rf loss, the sapphire ring must be fabricated with tight tolerance on: c-axis orientation, concentricity of dielectric ring 4 and hole 5, and parallelness between two end planes of the ring body 4. All surfaces should be polished to optical surface quality.

In general, the dielectric material for making the dielectric ring 4 of the present invention is not limited to sapphire. Any natural or synthetic dielectric material which has a relatively high dielectric constant (specifically, $\epsilon_r$ greater than 10) and extremely low loss tangent (specifically, tanδ less than $10^{-7}$) can be used.

Figure 3C:
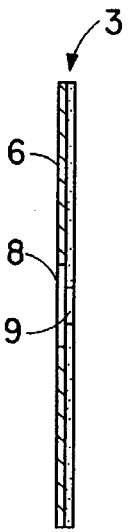
FIGS. 3*a*–3*c* are schematic drawings of the detailed structure of the HTS coated disks, 2 and 3, in the slow wave structure shown in FIGS. 1*a*–1*b*.
Figure 3B:
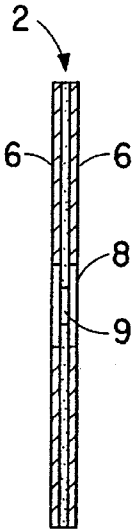
Figure 3A:
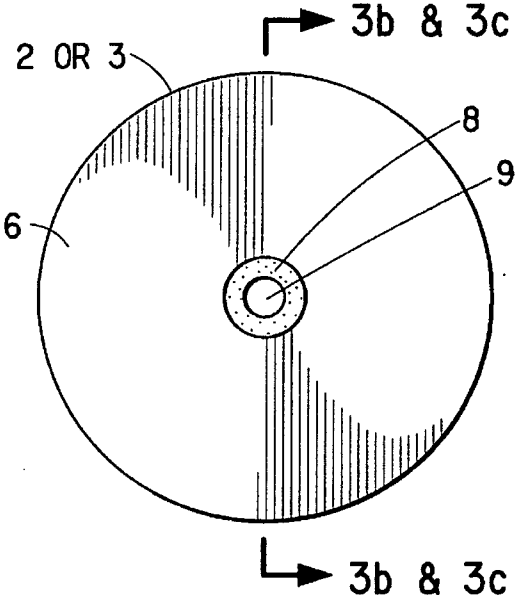

The particular periodic slow wave structure shown in FIGS. 1a–1b comprises five internal HTS thin film coated disks 2, and two end HTS thin film coated disks 3. FIGS. 3a–3b show the details of disks 2 and 3. FIG. 3a shows the front view of disks 2 or 3, and FIG. 3b and 3c show the cross-sectional view of disks 2 and 3, respectively. As shown in FIGS. 3a and 3b, the internal HTS-coated disk 2 comprises a substrate 7 (see FIG. 3b) with a through hole 9 at the center. HTS thin film 6 is deposited on both sides of substate 7 for disk 2. There is a disk area 8 uncoated by HTS film at the center of film 6. Note that the diameter of area 8 is larger than the diameter of hole 9 on substrate 7 because they have different functions. The hole 9 on substrate 7 is for the charged particle beam to pass through, and usually the diameter of the beam is small. The uncoated area 8 is not only for the beam to pass through, but also provides the rf coupling mechanism for the two sections adjacent to disk 2. The diameter of 8 must be sufficiently large to provide the required coupling. As shown in FIGS. 3*a* and 3*c*, the configurations of the end disk 3 are the same as those of internal disks 2 except that end disk 3 has a HTS thin film 6 coating only on one side of the substrate 7. The other side facing the case does not contact the rf field, therefore, no HTS coating is required.

The disk 3 having a HTS coating on a single side can also be used as an internal disk in the slow wave structure of the present invention. In that case, both sides of the single HTS film 6 are exposed to rf fields. As a result, rf currents also exist on both sides of the film 6. Therefore, disk 3 may handle less rf power than the HTS double side coated disks 2 and is less preferred for use in an internal position.

The HTS materials suitable for making the disks 2 or 3 have high critical temperature $T_c$, low surface resistance $R_c$, and high critical current density $J_c$. Such materials include, but are not restricted to, YBaCuO (123), TlBaCaCuO (2212 and 2223), TlPbSrCaCuO (1212 and 1223) and BiSrCaCuO (2223). In fact, any HTS material with a $T_c$ greater than about 90K, a $R_s$ less than about $5\times10^{-4}$ ohms/square (at 10 GHz and operating temperature), and a $J_c$ greater than about $1\times10^6$ amperes/square centimeters (at operating temperature and at operating frequency) can be used to fabricate the disks 2 and 3 in the HTS/dielectric slow wave structure of the present invention.

Substrates suitable for use in disks 2 or 3 are materials which are lattice matched to the HTS film employed, or which can be lattice matched to the HTS film employed using a buffer layer such as $CeO_2$. Examples of such materials include $LaAlO_3$, $NdGaO_3$, MgO, sapphire, and yttrium stabilized zirconia (YSZ).

Figure 6:
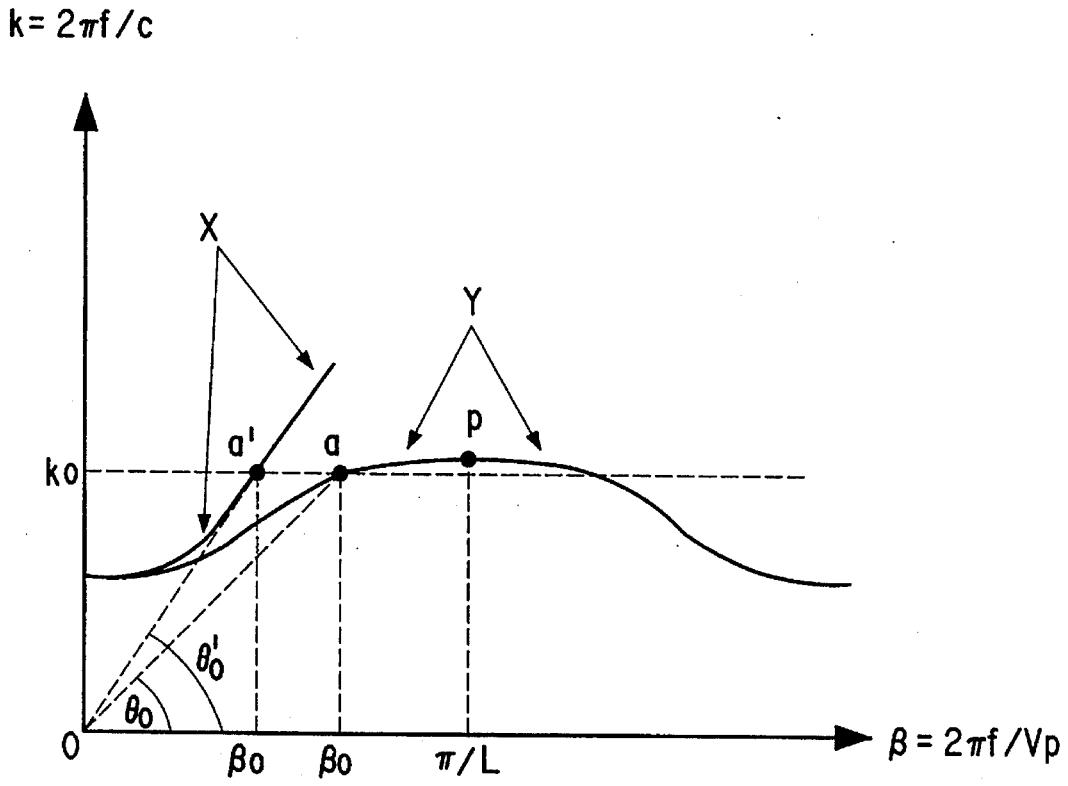
FIG. 6 is a graph of k vs. $\beta$ showing the generalized dispersion curve denoted as Y (k-$\beta$ curve) for the $TM_{01}$ mode of the slow wave structure shown in FIGS. 1*a*–1*b*, and the generalized dispersion curve, denoted as X, for the slow wave structure shown in FIGS. 4*a*–4*b*.

The inventive HTS/dielectric periodic slow wave structure, such as the embodiment shown in FIGS. 1*a*–1*b*, has high coupling impedance $Z_c$ and adjustable slow wave ratio. FIG. 6 shows its dispersion curve denoted as Y as a graph of k, the propagation constant in free space vs β, the propagation constant in the structure.

Figure 4A:
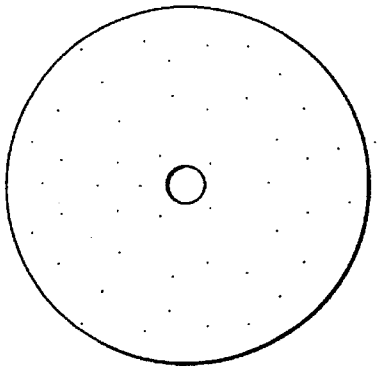
Figure 5A:
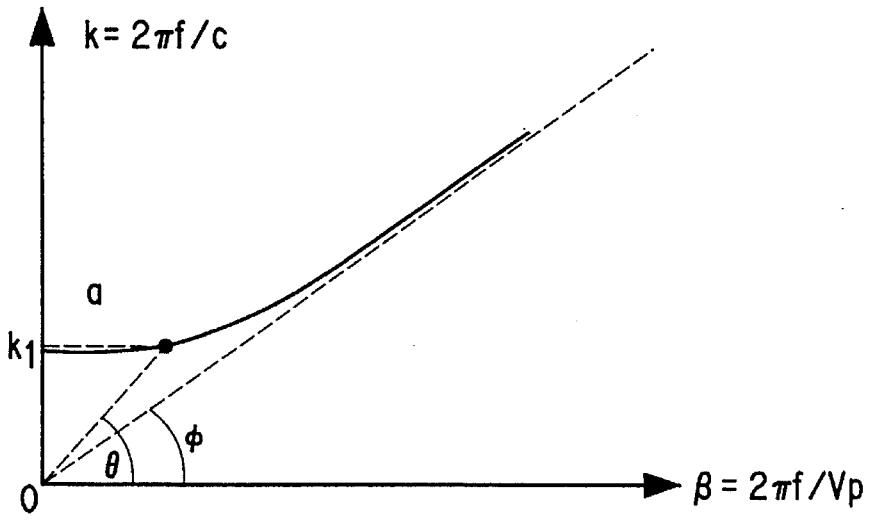
FIGS. 5*a*–5*b* are graphs showing the dispersion characteristics of the tubular dielectric slow wave structure shown in FIGS. 4*a*–4*b*.
Figure 5B:
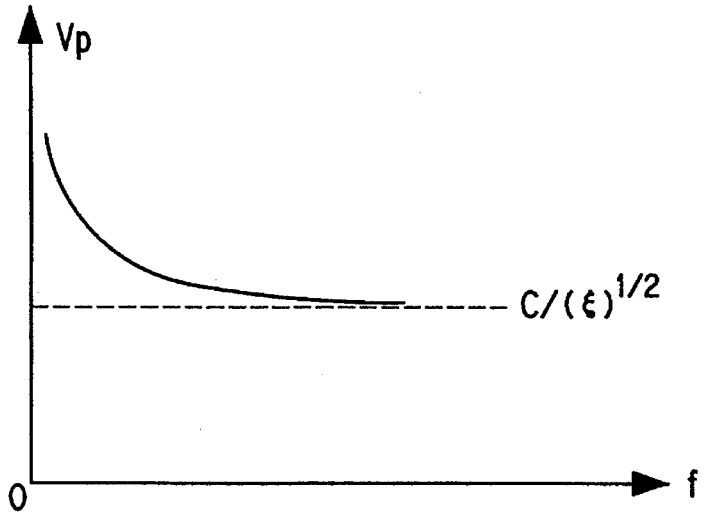

FIG. 5*a* shows the k-β curve of the slow wave structure shown in FIG. 4*a*, where $k_1$ is the propagation constant in free space at frequency $f_1$; β is the propagation constant in the slow wave; reference letter "a" denotes the point on the curve corresponding to propagation constant $k_1$;θ is the angle between the line 0-a and the β-axis; and ϕ is the angle between the asymptotic line to the curve and the β-axis. FIG. 5*b* shows the phase velocity ($v_p$) vs. frequency (f) curve in which c is the speed of light in the free space and $\epsilon_r$ is the relative dielectric constant of the dielectric tube. As can be seen by comparing FIG. 5*a* and FIG. 6, the periodic loading of HTS-coated disks pushes the k-β curve downward and makes it periodic along the β-axis. As best seen in FIG. 6*a*, the operating frequency $f_o=k_oc/(2\pi)$, the horizontal straight line at $k_o$ intersects the solid line k-β curve at point a. At this frequency, the HTS/dielectric periodic slow wave structure has a slow wave ratio of $$SWR=\beta_o/k_o=\cot\theta \quad (7)$$

For comparison purposes, the k-β curve of FIG. 5*a* for the unloaded tubular dielectric slow wave structure shown in FIG. 4*b* is also shown in FIG. 6 and denoted as X. At the same operating frequency $f_o=k_oc/(2\pi)$, the straight line at $k_o$ intersects the k-β curve at point a', which corresponds to a smaller SWR' of $$SWR'=\beta'_o/k_o=\cot\theta' \quad (8)$$

because of θ'>θ where θ' is the angle between the line O-a' and the β-axis and θ is the angle between the line O-a and the β-axis. Moreover, the k-β curve of the HTS/dielectric slow wave structure of the present invention can be adjusted to tailor the slow wave ratio according to the accelerator's requirement. For example, by keeping the same operating frequency $f_o$ and reducing the section length L, the π-mode point p at β=π/L and point a will shift toward the right along the straight line at $k=k_o$. Then θ will decrease and slow wave ratio will increase.

The 6-section periodic structure shown in FIGS. 1*a*–1*b* is only one embodiment of the inventive HTS/dielectric slow wave structure. The number of sections is not restricted to six. It can be any number according to the requirement of the accelerator's design.

Pseudo-Periodic Structure

FIGS. 7*a*–7*b* show an embodiment of the HTS/dielectric pseudo-periodic slow wave structure of the present invention, in which FIG. 7*a* shows an end view and FIG. 7*b* shows the longitudinal cross-sectional view. In this particular example, it is a 6-section pseudo-periodic structure. As best seen in FIG. 7*b*, it comprises 6 dielectric rings 1*a*–1*f* with different dimensions. The structure of the rings 1*a*–1*f* is the same as shown in FIGS. 2*a* and 2*b*. It also comprises five internal HTS-coated disks 2 with the same structure as shown in FIGS. 3*a*–3*b*, and two end HTS coated disks 3 with the same structure shown in FIGS. 3*a* and 3*c*. The difference between the periodic structure of FIGS. 1*a* and 1*b* and the pseudo-periodic structure of FIGS. 7*a* and 7*b* is that the latter has sections with changing dimensions. From the left to the right along the beam propagation direction, the section length L (see FIG. 7*b*) continuously increases and the outer diameter of the dielectric ring is adjusted in size (decreases) to keep the resonant frequency of the operating mode relatively constant for each section. Relatively constant is used herein to mean ±1%. The change in length L is a monochronic graduated change. As shown in FIG. 6 and as discussed above, the rf electromagnetic wave travels through the pseudo-periodic structure from left to right with a varying phase velocity. The phase velocity is slower at the left and faster at right because when the frequency is constant, the phase velocity $v_p$, increases as the section length L increases. In this way, when a charged particle beam enters the pseudo-periodic structure from the left with an initial injection speed, v, slightly smaller than the phase velocity $v_p$ at the left, due to the interaction with the rf field and gain of energy, it will increase in velocity along its propagation direction toward the right. The increasing of the phase velocity of the slow wave matches the increasing of the velocity of the charged particle beam to keep them synchronized, which makes the pseudo-periodic structure shown in FIG. 7 more efficient than the periodic structure shown in FIG. 1.

The 6-section pseudo-periodic structure shown in FIGS. 7*a*–7*b* is only one embodiment of the inventive HTS/dielectric slow wave structures. The number of sections is not restricted to six. It can be any number according to the requirement of the design of the accelerator.

Other arrangements are also possible. For example, groups of periodic structure shown in FIGS. 1*a*–1*b* can be used for constructing a composite slow wave structure, in which the group at the beam entrance end has a smaller $v_p$, the group at the beam exit end has a greater $v_p$, and the groups in between have intermediate gradually increasing $v_p$ from the entrance toward the exit.

Coupling Mechanisms

Normally, the slow wave structure is fed by a rf source through a waveguide to the first section where the charged particle beam is injected. The electro-magnetic slow wave propagates along the longitudinal direction of the structure via the coupling mechanisms between the adjacent sections. For the structures shown in FIGS. 1*a*–1*b* and FIGS. 7*a*–7*b*, the coupling mechanism, as shown in FIGS. 3*a*–3*c*, is the disk area 8 uncoated by the HTS film 6 at the center of the HTS coated disk 2 or 3. Notice that in FIGS. 3*a*–3*c*, the disk area 8 uncoated by the HTS film 6 is larger than the opening 9 on the substrate 7. The reason is that the size of opening 9 is determined by the cross-sectional size of the charged particle beam, which should be large enough to let the beam go through without interception. But the size of the disk area 8 uncoated by the HTS film is determined by the rf coupling requirement, which is usually larger than that of the opening 9. The size of the uncoated disk area 8 not only determines the inter-section coupling, but also determines the k-β curve, the slow wave ratio, and the coupling impedance $Z_c$. In general, a larger uncoated disk area 8 provides a stronger inter-section coupling, a smaller slow wave ratio, and a lower coupling impedance $Z_c$. To satify all the requirements of an accelerator, a certain compromise is needed to determine the size of the uncoated disk area 8. When the uncoated disk area 8 is ring-shaped as shown in FIG. 3*a*, an increase in its size promotes stronger coupling to propagate the wave to the next section, but it also results in a smaller slow wave ratio and a lower coupling impedance.

Figure 8A:
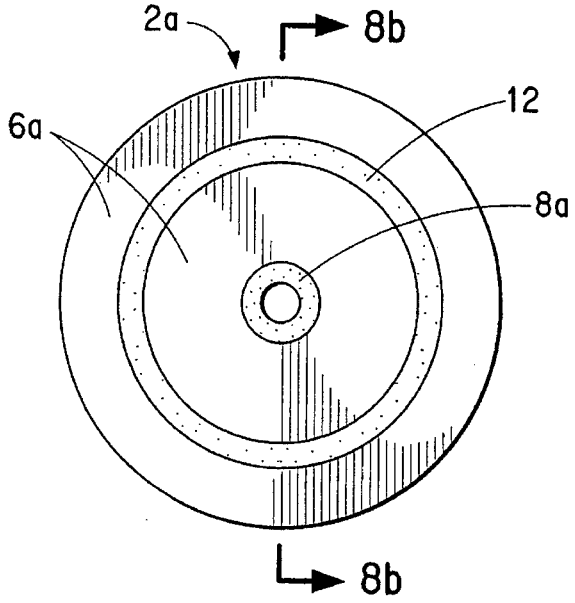
FIGS. 8*a*–8*b* are schematic drawings of an HTS coated disk with two ring shaped areas uncoated by HTS film as a coupling mechanism.
Figure 8B:
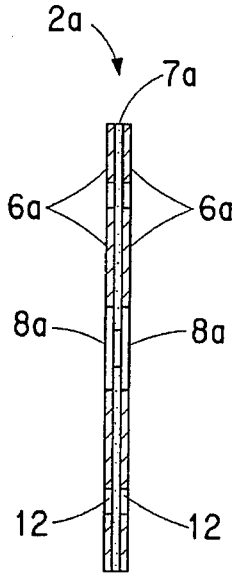

To avoid this compromise, the present invention also comprises alternative means for inter-section coupling. FIGS. 8*a*–8*b* show one embodiment of an HTS-coated disk 2*a* with a concentric coupling ring 12 to replace the internal disk 2 in the structures shown in FIGS. 1*a*–1*b* and 7*a*–7*b*. FIG. 8*a* shows a front view and FIG. 8*b* shows a cross-sectional view. Concentric coupling ring 12 is a ring shaped area of the disk uncoated by the HTS film 6*a* deposited on both sides of the substrate 7*a* (see FIG. 8). Except for the said ring 12, all elements of disk 2*a* are the same as disk 2 previously described. If disk 2*a* is used to replace disk 2 in the structures shown in FIGS. 1*a*–1*b* and 7*a*–7*b*, the inter-section coupling will be achieved by both the uncoated area 8*a* and the uncoated ring 12. This gives the flexibility of separately adjusting the dispersion curve and the coupling impedance $Z_c$. For example, the $Z_c$ is mainly determined by the size of the area 8*a*. For a given size area 8*a*, the dispersion curve and the slow wave ratio can be adjusted by changing the location and the width of the ring 12.

Figure 9A:
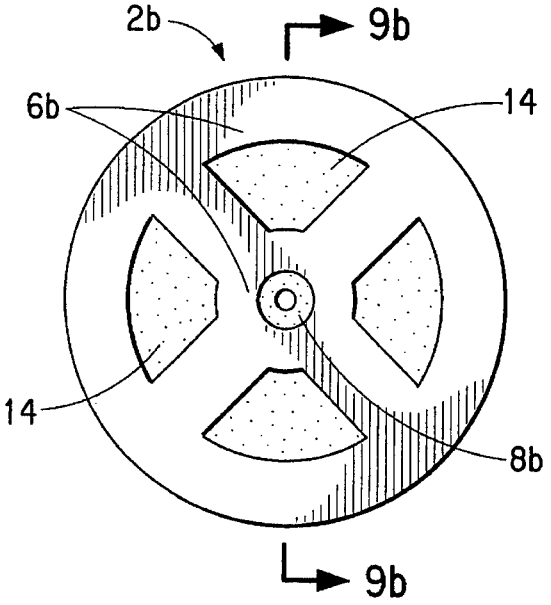
FIGS. 9*a*–9*b* are schematic drawings of an HTS coated disk with four symmetrical areas uncoated by HTS film as a coupling mechanism.
Figure 9B:
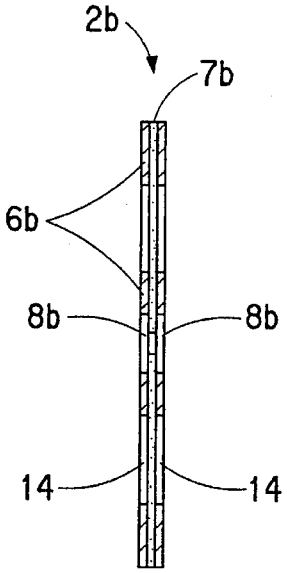

FIGS. 9*a*–9*b* show another embodiment of an alternative internal HTS disk 2*b*, in which FIG. 9*a* is a front view and FIG. 9*b* is a cross-sectional view. In this particular example, additional coupling is introduced by four symmetrical disk areas 14 uncoated by the HTS film 6*b* deposited on the substrate 7*b* (see FIG. 9*b*). If disk 2*b* is used to replace disk 2 in the structures shown in FIGS. 1*a*–1*b* and 7*a*–7*b*, the inter-section coupling will be achieved by both the uncoated disk area 8*b* and the uncoated disk areas 14. This also gives the flexibility of separately adjusting the dispersion curve and the coupling impedance $Z_c$. For example, the $Z_c$ is mainly determined by the size of the area 8*b*. For a given size area 8*b*, the dispersion curve and the slow wave ratio can be adjusted by changing the location and the size of the uncoated disk areas 14. FIGS. 9*a*–9*b* represent only one coupling embodiment. The number and the shape of the coupling uncoated areas are not restricted to the particular embodiment shown in FIGS. 9*a*–9*b*. In fact, any set of uncoated disk areas with different shapes and locations are acceptable as long as the azithmatic symmetry is maintained.

Enclosure

To be used in accelerators and traveling wave tubes, the HTS/dielectric slow wave structures of the present invention comprising sub-assembly parts 1, 2, and 3 as shown in FIGS. 1*a*–1*b* and 7*a*–7*b* is packaged in an enclosure with particular accessories. The function of the enclosure is to hold the sub-assembly of the slow wave structure, to provide a vacuum seal, and to provide a thermal path for cryogenic cooling of the HTS films.

Figure 10A:
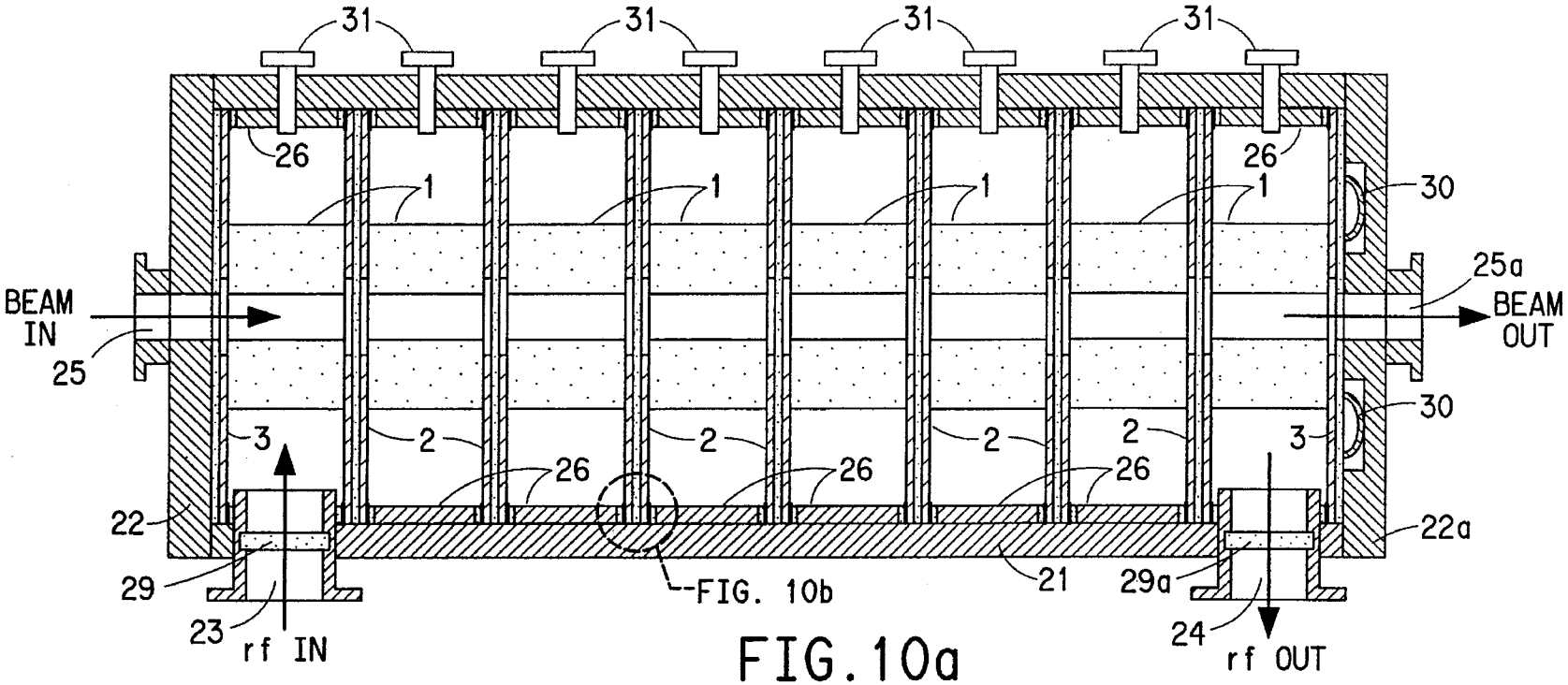
FIGS. 10*a*–10*b* are schematic drawings of an embodiment of an HTS/dielectric slow wave structure within an enclosure case with accessories.
Figure 10B:
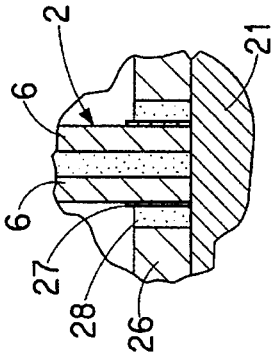

The accessories include: rf power input and output ports, tuning mechanisms and connections to charged particle source and collector. FIGS. 10*a*–10*b* show one embodiment of an assembled slow wave structure of the present invention. FIG. 10*a* is a longitudinal cross-sectional view and FIG. 10*b* is an exploded view showing the details of the connections between the HTS coated disk and the enclosure.

In FIG. 10*a*, the particular 8-section periodic HTS/dielectric slow wave structure comprises eight dielectric rings 1, seven internal HTS-coated disks 2, and two end HTS-coated disks 3, configured in a way similar to that shown in FIG. 1. The periodic slow wave structure is held by a metallic case comprising a case body 21, and two end plates 22 and 22*a*. To provide an efficient thermal path for the HTS films, the case parts 21, 22 and 22*a* are made of metals or metallic alloys with high thermal conductivity such as oxygen free copper, which may have a thermal expansion coefficient (TEC) different from that of the HTS/dielectric subassembly comprising parts 1, 2 and 3. In order to maintain the rigidity of the structure, springs 30 are used for holding the sub-assembly in place and to compensate for any thermal expansion or contraction during the room temperature to cryogenic temperature cycles.

The rf power is introduced into the slow wave structure via a waveguide 23 as the input port (rf in). The waveguide 24 serves as the rf output port (rf out). Vacuum sealed windows 29 and 29*a* are used to maintain a vacuum inside the case and to let the rf power pass through. Flange 25 provides a connection from the slow wave structure to the charged particle source (not shown), which serves as the inlet for the charged particle beam (BEAM in) to the slow wave structure. Flange 25*a* provides a connection from the slow wave structure to the charged particle collector (not shown), which serves as the outlet for the charge particle beam (Beam out).

In this example, there are eight tuner rods 31 inserted through holes in the case body 21 into each section of the slow wave structure. The tuning rods are perpendicular to the dielectric rings. The depth of penetration into the enclosure of each tuning rod is adjustable. The tuner rods create a disturbance of the rf field which alters the phase velocity. The function of the tuner rods is to fine tune the dispersion curve of the slow wave structure for the optimum synchronization of velocity between the rf wave and the charged particle beam in order to achieve the maximum efficiency. The tuner rods can be made of conductors with high conductivity for magnetic tuning or made of dielectric materials with high dielectric constant and low loss tangent for electrical tuning.

For mechanical rigidity and thermal efficiency, the dielectric rings 1, and the HTS-coated disks 2 and 3 must be held in one piece as a sub-assembly. The contact between the dielectric rings 1 and the HTS coated disks 2 or 3 can be achieved by applying some low rf loss glue such as an amorphous fluoropolymer, for example, Teflon® AF, as an adhesive. Metallic rings 26 are used as an additional holding mechanism to reinforce the sub-assembly, and to also provide a better thermal path for the HTS disks to the enclosure. FIG. 10*b* shows an exploded view of the connection among the HTS disk 2, the metallic ring 26 and the case body 21. At the very edge of HTS disk 2 a ring shaped metalization layer 27 is deposited onto the HTS film 6. A gasket 28 is placed into the gap between the metallic ring 26 and the metalization layer 27 for a secure connection.

FIGS. 10*a*–10*b* represent only one embodiment of the HTS/dielectric structure. The present invention is not restricted to this particular configuration. For example, in FIGS. 10*a*–10*b* the periodic structure can be replaced by a pseudo-periodic structure such as the one shown in FIGS. 7*a*–7*b*. The slow wave structure shown in FIGS. 10*a*–10*b* comprises the internal HTS disks 2 as shown in FIG. 3, in which the intersection coupling is solely via the disk area 8 uncoated by the HTS film 6. It can be replaced by the alternative HTS coated disks 3*a* (with ring coupling 12) shown in FIGS. 8*a*–8*b* or by the HTS-coated disks 3*b* (with symmetrical uncoated areas 14 coupling) shown in FIGS. 9*a*–9*b*. The number of sections is not restricted to eight as the example shown in FIGS. 10*a*–10*b*.

The waveguide version of the rf input port 23 and the output port 24 can be replaced by a coaxial line version. In case of an accelerator using more than one rf source, multiple input ports can be used, which are located at different sections along the longutudinal direction of the slow wave structure. In this case, the phases of the different sources must be adjusted appropriately to match the phase shift in the slow wave structure.

The periodic and psuedo-periodic structures of the present invention permit more compact accelerators and traveling wave tubes by shortening their length to as low as two to three feet. The slow wave structures of the present invention have extremely high Q-values of at least about one hundred times more than conventional structures and thus represent improved efficiency in operation.

An additional aspect of the present invention comprises an improved charged particle accelerator and an improved traveling wave tube of compact size wherein the improvement comprises incorporation of the periodic or pseudo-periodic slow wave structure of the present invention as previously described. The accelerator and traveling wave tube can be of any conventional design known to those skilled in the art except that the slow wave structure component comprises that of the present invention. Such accelerators are useful in research and medical applications. In particular they are useful for the treatment of diseased human tissue with various types of radiation.

What is claimed is:

1. A slow wave structure operating in a mode having a longitudinal energy field and thus suitable for use in for changing velocity of a beam of charged particles, said structure comprising:

(a) an enclosure having a particle beam entry port, a particle beam exit port, and distinct radio frequency entry and exit ports;

(b) a plurality of spaced-apart disks disposed within said enclosure, said disks each having a respective central aperture in a center thereof and comprising a respective high temperature superconducting film;

(c) a respective cylindrical shaped dielectric ring disposed between and in contact with a pair of adjacent disks, said respective ring having a respective aperture in a center thereof and being of reduced size as compared to said corresponding disks, said respective ring being positioned relative to said corresponding disks to align the aperture in the center of the respective ring with the central apertures in the corresponding disks;

(d) a central longitudinal bore traversing said structure defined by the aligned apertures of said respective ring and said corresponding disks, said bore further being aligned with said particle beam entry port and said particle beam exit port on the enclosure;

(e) coupling means operatively associated with said respective disks for propagating a wave through said central bore of the structure; and (f) tuning means operatively associated with said enclosure for tuning phase velocity of a slow wave when a slow wave is propagating in said structure.

2. A pseudo-periodic slow wave structure operating in a mode having a longitudinal energy field and thus suitable for use in changing velocity of a beam of charged particles, said structure comprising:

(a) an enclosure having a particle beam entry port, a particle beam exit port, and distinct radio frequency entry and exit ports;

(b) a plurality of spaced-apart disks disposed within said enclosure, said disks each having a respective central aperture in a center thereof and comprising a respective high temperature superconducting film;

(c) a respective cylindrical shaped dielectric ring disposed between and in contact with a pair of adjacent disks, said respective ring having a respective aperture in a center thereof and being of reduced size as compared to said corresponding disks, said respective ring being positioned relative to said corresponding disks to align the aperture in the center of the respective ring with the central apertures in the corresponding disks;

(d) wherein the dielectric ring closest to the particle beam entry port has a shorter length and a greater diameter than the dielectric ring closest to the particle beam exit port, and wherein respective dielectric rings therebetween have progressively increasing lengths and a progressively decreasing diameters;

(e) a central longitudinal bore traversing said structure defined by the aligned apertures of said respective rings and said corresponding disks, said bore further being aligned with said particle beam entry port and said particle beam exit port on the enclosure;

(f) coupling means operatively associated with said disks for propagating a wave through said central bore of the structure; and (g) tuning means operatively associated with said enclosure for tuning phase velocity of a slow wave when a slow wave is propagating in said structure.

3. The slow wave structure of claim 1 or 2 wherein each superconducting film has a $T_c$ of greater than about 90K, a surface resistance $R_s$ of less than about $5\times10^{-4}$ ohms/square at 10 GHz, and a critical current density $J_c$ greater than about $1\times10^{+6}$ amperes/square centimeter.

4. The slow wave structure of claim 3 wherein each superconducting film is selected from the group consisting of YBaCuO (123), TlBaCaCuO (2212), TlBaCaCuO (2223), TlPbSrCaCuO (1212) and TlPbSrCaCuO (1223).

5. The slow wave structure of claim 3, wherein each of the plurality of disks comprise a superconducting film deposited on at least one major surface of a lattice substrate, wherein said substrate is matched to said film and is selected from the group consisting of $LaAlO_3$, $NdGaO_3$, MgO, sapphire and yttrium stabilized zirconia.

6. The slow wave structure of claim 1 or 2 wherein each dielectric ring is of a material having a dielectric constant of greater than 10 and a loss tangent of less than $10^{-7}$.

7. The slow wave structure of claim 6 wherein at least one dielectric ring is sapphire.

8. The slow wave structure of claim 1 or 2 wherein the coupling means comprises at least one discrete area on each disk arranged in a symmetrical pattern around the central aperture of said disk which area is free of high temperature superconducting film.

9. The slow wave structure of claim 1 or 2 wherein the coupling means comprises at least one ring-shaped area on each disk positioned concentric to the central aperture of the disk, said respective area is free of the high temperature superconducting film.

10. The slow wave structure of claim 1 or 2 wherein the tuning means comprises at least one tuner rod carried by the enclosure wherein said rod traverses said enclosure such that a portion of the rod is located within said enclosure, said rod being adjustably movable relative to said enclosure and disposed perpendicular to the central longitudinal bore of said structure.

11. The slow wave structure of claim 10 wherein one tuner rod is present for each dielectric ring in the structure.

12. The slow wave structure of claim 1 or 2 wherein the discrete radio frequency entry and exit ports are respectively vacuum sealed.

13. The slow wave structure of claim 1 or 2 wherein said structure forms an element of a traveling wave tube.

14. A traveling wave tube comprising a slow wave structure operating in a mode having a longitudinal energy field and thus suitable for use in for changing velocity of a beam of charged particles, wherein said slow wave structure comprises:

(a) an enclosure having a particle beam entry port, a particle beam exit port, and distinct radio frequency entry and exit ports;

(b) a plurality of spaced-apart disks disposed within said enclosure, said disks each having a respective central aperture in a center thereof and comprising a respective high temperature superconducting film;

(c) a respective cylindrical shaped dielectric ring disposed between and in contact with a pair of adjacent disks, said respective ring having a respective aperture in a center thereof and being of reduced size as compared to said corresponding disks, said respective ring being positioned relative to said corresponding disks to align the aperture in the center of the respective ring with the central apertures in the corresponding disks;

(d) a central longitudinal bore traversing said structure defined by the aligned apertures of said respective ring and said corresponding disks, said bore further being aligned with said particle beam entry port and said particle beam exit port on the enclosure;

(e) coupling means operatively associated with said respective disks for propagating a wave through said central bore of the structure; and (f) tuning means operatively associated with said enclosure for tuning phase velocity of a slow wave when a slow wave is propagating in said structure.

15. A charged particle accelerator comprising a pseudo-periodic slow wave structure operating in a mode having a longitudinal energy field and thus suitable for use in for changing velocity of a beam of charged particles, wherein said slow wave structure comprises:

(a) an enclosure having a particle beam entry port, a particle beam exit port, and distinct radio frequency entry and exit ports;

(b) a plurality of spaced-apart disks disposed within said enclosure, said disks each having a respective central aperture in a center thereof and comprising a respective high temperature superconducting film;

(c) a respective cylindrical shaped dielectric ring disposed between and in contact with a pair of adjacent disks, said respective ring having a respective aperture in a center thereof and being of reduced size as compared to said corresponding disks, said respective ring being positioned relative to said corresponding disks to align the aperture in the center of the respective ring with the central apertures in the corresponding disks;

(d) wherein the dielectric ring closest to the particle beam entry port has a shorter length and a greater diameter than the dielectric ring closest to the particle beam exit port, and wherein respective dielectric rings therebetween have progressively increasing lengths and a progressively decreasing diameters;

(e) a central longitudinal bore traversing said structure defined by the aligned apertures of said respective ring and said corresponding disks, said bore further being aligned with said particle beam entry port and said particle beam exit port on the enclosure;

(f) coupling means operatively associated with said respective disks for propagating a wave through said central bore of the structure; and (g) tuning means operatively associated with said enclosure for tuning phase velocity of a slow wave when a slow wave is propagating in said structure.

16. A traveling wave tube comprising a slow wave structure operating in a mode having a longitudinal energy field and thus suitable for use in for changing velocity of a beam of charged particles, wherein said slow wave structure comprises:

(a) an enclosure having a particle beam entry port, a particle beam exit port, and distinct radio frequency entry and exit ports;

(b) a plurality of spaced-apart disks disposed within said enclosure, said disks each having a respective central aperture in a center thereof and comprising a respective high temperature superconducting film;

(c) a respective cylindrical shaped dielectric ring disposed between and in contact with a pair of adjacent disks, said respective ring having a respective aperture in a center thereof and being of reduced size as compared to said corresponding disks, said respective ring being positioned relative to said corresponding disks to align the aperture in the center of the respective ring with the central apertures in the corresponding disks;

(d) wherein the dielectric ring closest to the particle beam entry port has a shorter length and a greater diameter than the dielectric ring closest to the particle beam exit port, and wherein respective dielectric rings therebetween have progressively increasing lengths and a progressively decreasing diameters;

(e) a central longitudinal bore traversing said structure defined by the aligned apertures of said respective ring and said corresponding disks, said bore further being aligned with said particle beam entry port and said particle beam exit port on the enclosure;

(f) coupling means operatively associated with said respective disks for propagating a wave through said central bore of the structure; and (g) tuning means operatively associated with said enclosure for tuning phase velocity of a slow wave when a slow wave is propagating in said structure.

17. A charged particle accelerator comprising a slow wave structure operating in a mode having a longitudinal energy field and thus suitable for use in for changing velocity of a beam of charged particles, wherein said slow wave structure comprises:

(a) an enclosure having a particle beam entry port, a particle beam exit port, and distinct radio frequency entry and exit ports;

(b) a plurality of spaced-apart disks disposed within said enclosure, said disks each having a respective central aperture in a center thereof and comprising a respective high temperature superconducting film;

(c) a respective cylindrical shaped dielectric ring disposed between and in contact with a pair of adjacent disks, said respective ring having a respective aperture in a center thereof and being of reduced size as compared to said corresponding disks, said respective ring being positioned relative to said corresponding disks to align the aperture in the center of the respective ring with the central apertures in the corresponding disks;

(d) a central longitudinal bore traversing said structure defined by the aligned apertures of said respective ring and said corresponding disks, said bore further being aligned with said particle beam entry port and said particle beam exit port on the enclosure;

(e) coupling means operatively associated with said respective disks for propagating a wave through said central bore of the structure; and (f) tuning means operatively associated with said enclosure for tuning phase velocity of a slow wave when a slow wave is propagating in said structure.

* * * * *